US010264819B2

(12) United States Patent
Smith et al.

(10) Patent No.: US 10,264,819 B2
(45) Date of Patent: Apr. 23, 2019

(54) ELECTRONIC SMOKING ARTICLE

(71) Applicant: Altria Client Services LLC, Richmond, VA (US)

(72) Inventors: Barry S. Smith, Hopewell, VA (US); Eric Hawes, Midlothian, VA (US); David Schiff, Highland Park, NJ (US); Chris Carrick, Newark, DE (US); Tony Gatta, Philadelphia, PA (US); Jonathan D. Albert, Philadelphia, PA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 799 days.

(21) Appl. No.: 14/204,775

(22) Filed: Mar. 11, 2014

(65) Prior Publication Data

US 2014/0261493 A1 Sep. 18, 2014

Related U.S. Application Data

(60) Provisional application No. 61/794,978, filed on Mar. 15, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06
USPC ..... 131/329
See application file for complete search history.

(56) References Cited

U.S. PATENT DOCUMENTS

| | | | | |
|---|---|---|---|---|
| 9,675,107 | B2 * | 6/2017 | Levitz | A24F 47/008 |
| 2011/0011396 | A1 * | 1/2011 | Fang | A24F 47/008 128/202.21 |
| 2013/0056013 | A1 | 3/2013 | Terry et al. | |
| 2013/0228191 | A1 * | 9/2013 | Newton | A24F 47/008 131/329 |

FOREIGN PATENT DOCUMENTS

| | | | | |
|---|---|---|---|---|
| CN | 101878958 | A | 11/2010 | |
| CN | 102499488 | A | 6/2012 | |
| CN | 202311183 | U | 7/2012 | |
| DE | 2653133 | A1 | 5/1978 | |
| GB | 1403093 | A * | 8/1975 | H01R 13/6278 |

(Continued)

OTHER PUBLICATIONS

Bayonet mount ,Wikipedia ,Feb. 21, 2009.*

(Continued)

*Primary Examiner* — Joseph S Del Sole
*Assistant Examiner* — Mohamed K Ahmed Ali
(74) *Attorney, Agent, or Firm* — Harness, Dickey & Pierce, P.L.C.

(57) ABSTRACT

An electronic smoking article includes a first section containing a liquid supply reservoir including liquid material, a heater operable to heat the liquid material to a temperature sufficient to vaporize the liquid material and form an aerosol, and a wick in communication with the liquid material and operable to deliver the liquid material to the heater, and a second section containing a power supply. The first section is connected to the second section with a connection including a first connector piece and a second connector piece.

13 Claims, 3 Drawing Sheets

(56) References Cited

FOREIGN PATENT DOCUMENTS

| | | | | |
|---|---|---|---|---|
| UA | 67598 U | 2/2012 | | |
| UA | A201211032 | 5/2013 | | |
| WO | WO 2013040193 A2 * | 3/2013 | ..... | A61M 15/06 |

OTHER PUBLICATIONS

International Preliminary Report on Patentability PCT/IB/373 for International Application No. PCT/US2014/024194 dated Sep. 15, 2015.
Written Opinion of the International Searching Authority PCT/ISA/237 for International Application No. PCT/US2014/024194 dated Jul. 15, 2015.
Office Action for corresponding Chinese Application No. 201480021587.2 dated Apr. 21, 2017 and English translation thereof.
Office Action for corresponding Russian Application No. 2015144316 dated Jul. 31, 2017 and English translation thereof.
Office Action for corresponding Ukranian Application No. a201510028 dated Jul. 25, 2017 and English translation thereof.
Office Action for corresponding Chinese Application No. 201480021587.2 dated Sep. 26, 2017 and English translation thereof.
Office Office Action for corresponding Chinese Application No. 201480021587.2 dated Dec. 27, 2017 and English translation thereof.
European Office Action dated Mar. 5, 2018 for corresponding European Application No. 14719427.8.

* cited by examiner

ELECTRONIC SMOKING ARTICLE

CROSS-REFERENCE TO RELATED APPLICATION

This application claims priority under 35 U.S.C. § 119(e) to U.S. provisional Application No. 61/794,978, filed on Mar. 15, 2013, the entire content of which is incorporated herein by reference thereto.

SUMMARY OF SELECTED FEATURES

An electronic smoking article is provided which includes a heater element which vaporizes liquid material to produce an aerosol or "vapor". The heater element preferably comprises a resistive heater coil, with a wick extending therethrough and into a liquid supply reservoir.

The heater, wick and liquid supply reservoir are preferably contained in a first section. A power supply, puff sensor and control circuitry are preferably contained in a second section. The first section and the second section are connected together using a connector. The connector includes a first connector piece attached to a section of the electronic smoking article and a second connector piece attached to the other section of the electronic smoking article. The first connector piece fits within the second connector piece so as to lock the first section and the second section together.

DETAILED DESCRIPTION

Heretofore, a conventional electronic smoking article can include two sections mated together at a connection, such as a threaded connection. Threaded connections can be difficult to use because of the need to line up the threads, and the possibility that the two sections will not be properly connected for airflow or graphics.

Described herein are connections that allow for easy and reliable connection and disconnection. With such connections, a first section and a second section of an electronic smoking article are easily and reliably aligned each time the first and second sections are connected.

Figure 1:
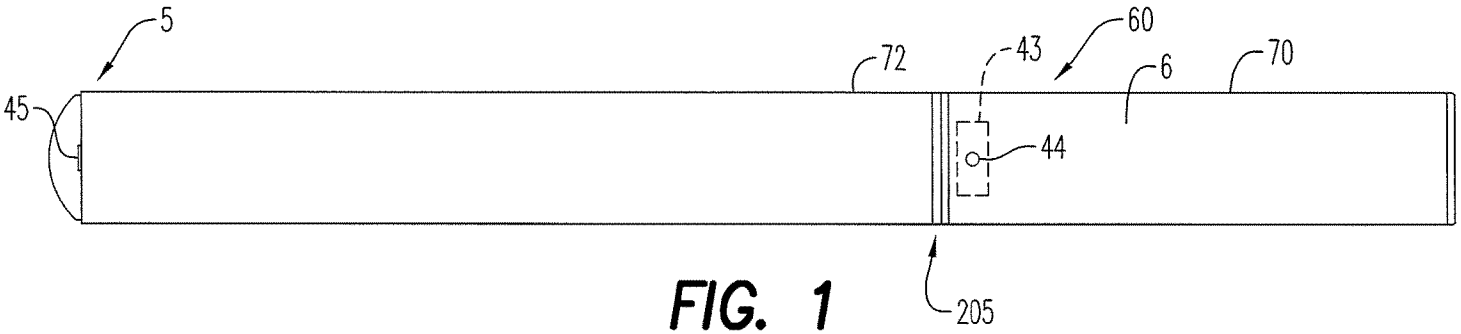
FIG. 1 is a top planar view of an electronic smoking article according to a first embodiment.
Figure 2:
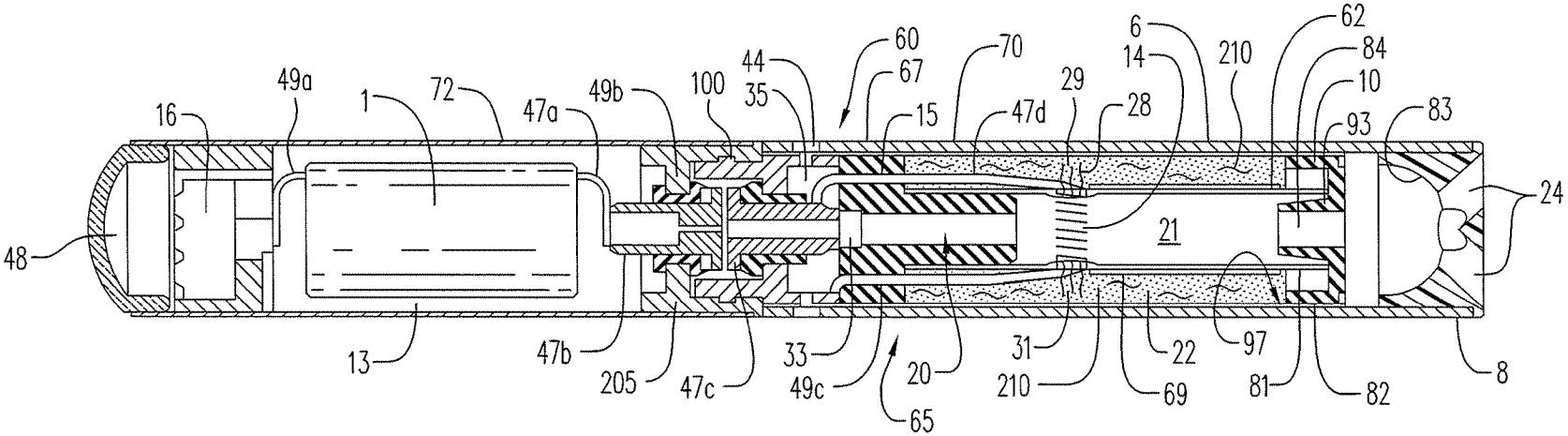
FIG. 2 is a side cross-sectional view of the electronic smoking article shown in FIG. 1 and including a connector.
Figure 3:
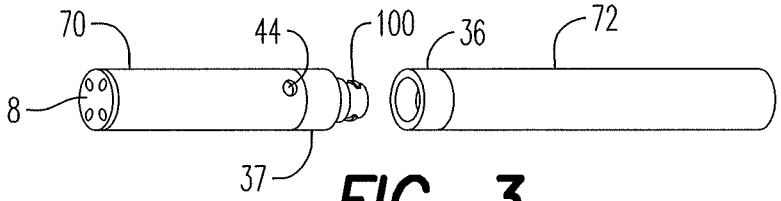
FIG. 3 is a perspective view of the electronic smoking article of FIG. 2, but with the first and second sections separated from each other.
Figure 4:
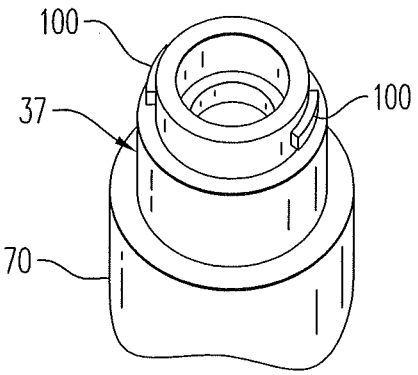
FIG. 4 is a perspective view of a first connector piece.
Figure 5:
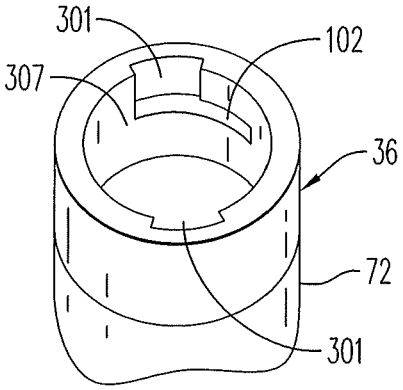
FIG. 5 is a perspective view of a second connector piece.

Referring to FIGS. 1 and 2, the electronic smoking article 60 is provided and comprises a replaceable cartridge (or first section) 70 and a reusable fixture (or second section) 72, which in the preferred embodiment are coupled together at a connection 205. Preferably, the second section 72 includes a puff sensor 16 responsive to air drawn into the second section 72, a battery 1 and control circuitry integrally arranged with the puff sensor 16. The disposable first section 70 preferably includes a liquid supply reservoir 22 (including liquid and optionally a fibrous media 210), a wick 28 that wicks liquid from the liquid supply reservoir 22, and a heater element 14 that heats the liquid in the wick to form an aerosol in a central air channel 21. Upon completing the connection 205, the battery 1 is electrically connected with the heater element 14 of the first section 70 upon actuation of the puff sensor. Air is drawn primarily into the first section 70 through one or more air inlets 44.

The electronic smoking article 60 described herein can be disposable or reusable. In the preferred embodiment, once the liquid of the cartridge is spent, only the first section 70 is replaced.

In a preferred embodiment, the electronic smoking article 60 is preferably about the same size as a conventional cigarette. In some embodiments, the electronic smoking article 60 can be about 80 mm to about 110 mm long, preferably about 80 mm to about 100 mm long and about 7 mm to about 8 mm in diameter. For example, in a preferred embodiment, the electronic smoking article is about 84 mm long and has a diameter of about 7.8 mm.

Preferably, the first section 70 includes an outer tube (or casing) 6 extending in a longitudinal direction and an inner tube (or chimney) 62 coaxially positioned within the outer tube 6. Preferably, a nose portion 61 of an upstream gasket (or seal) 15 is fitted into an upstream end portion 65 of the inner tube 62, while at the same time, an outer perimeter 67 of the gasket 15 provides a liquid-tight seal with an interior surface 97 of the outer casing 6. The upstream gasket 15 also includes a central, longitudinal air passage 20, which opens into an interior of the inner tube 62 that defines the central channel 21. A transverse channel 33 (shown in FIGS. 2 and 6) at an upstream portion of the gasket 15 intersects and communicates with the central passage 20 of the gasket 15. This channel 33 assures communication between the central passage 20 and a space 35 in fluid communication with air inlets 44.

Preferably, at least one adhesive-backed label is applied to the outer tube 6. The label completely circumscribes the electronic smoking article 60 and can be colored and/or textured to provide the look and/or feel of a traditional cigarette. The label can include holes therein which are sized and positioned so as to prevent blocking of the air inlets 44.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle.

Figure 10:
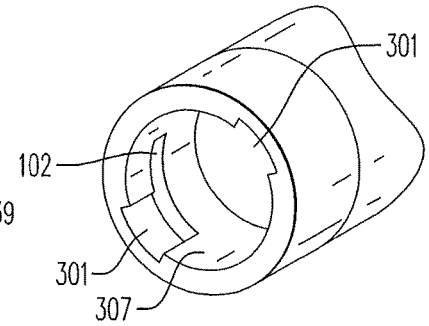
FIG. 10 is a second perspective view of the second connector piece of FIG. 5.

In a preferred embodiment, and shown in FIGS. 2-6, the connection 205 includes a first connector piece 37 and a second connector piece 36. The first connector piece 37 includes a pair of opposing protrusions 100 that mate with a pair of opposing internal grooves 102 (shown in FIG. 5) or slots 102' (shown in FIG. 7) in the second connector piece 36. Alternatively, the protrusions 100 can mate with a pair of opposing internal teeth (not shown). A pair of longitudinally extending channels 301 (shown in FIGS. 5 and 10) extend from the opposing, internal grooves 102 along an internal wall 307 of the second connector piece 36 and are operable to slidingly receive the protrusions 100 of the first connector piece 37 upon initiation of a connection. Preferably, the protrusions 100 and the opposing internal grooves or slots 102, 102' are each positioned about 180° apart. Preferably, each groove 102 (or slot 102') is oriented transversally of a longitudinal channel 301, preferably at a 90° angle. In other embodiments, the protrusions 100 and grooves or slots 102, 102' could be positioned in alternate locations and/or additional protrusions and grooves or slots could be included.

Figure 6:
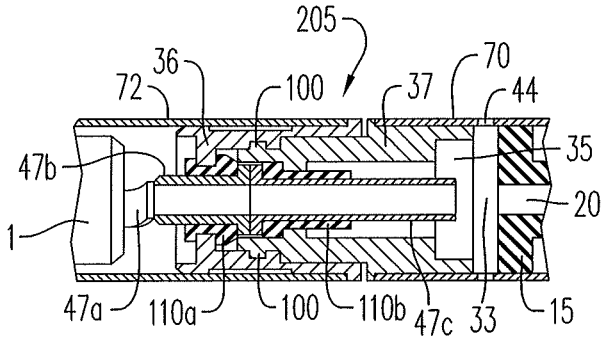
FIG. 6 is an enlarged, cross-sectional view of the connector of FIG. 2.

In addition, as shown in FIG. 6, the connection 205 preferably includes one or more rubber (resilient) gaskets 110*a*, 110*b* positioned about an anode post 47*c* of the first section 70 and an anode connection post 47*b* of the second section 72, which provide an electrical connection, extending through the connection 205. The rubber gaskets are axially compressed when the first connector piece 37 is inserted into the second connector piece 36 so as to provide a tactile sensation (feedback) that signifies the connection 205 has been formed.

Figure 7:
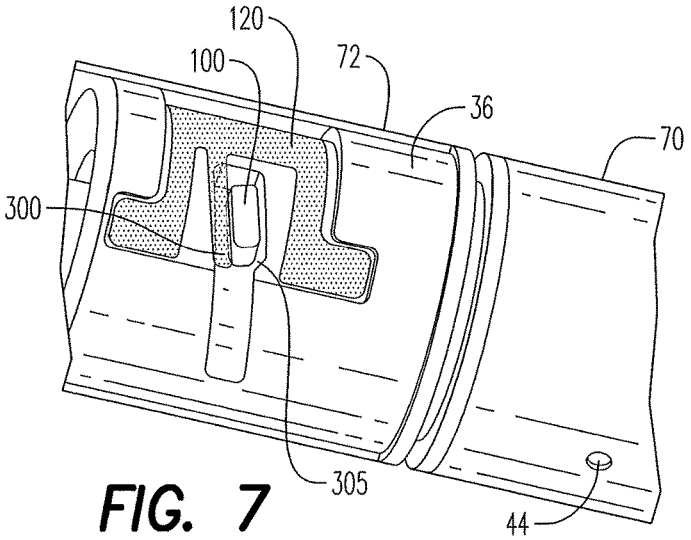
FIG. 7 is an enlarged, perspective view of the connector of FIG. 2.
Figure 8:
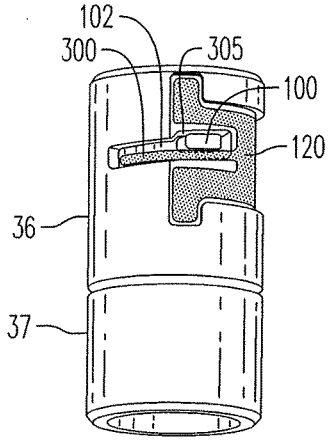
FIG. 8 is a side, perspective view of the connector of FIG. 2.

In an embodiment, an external spring clip 120, shown in FIG. 8, on the second connector piece 36, such as a leaf spring or a wire spring, can provide audible feedback as the protrusions 100 enter the opposing grooves 102 (or slots 102') and slide into a step 305 of the second connector piece 36 (shown in FIGS. 7 and 8). Accordingly, the external spring clip 120 can include an appendage portion 300 which slides into the groove 102 (or slot 102') beside the protrusion 100 (shown in FIGS. 7 and 8) to produce an amplified audible sound if desired. However, the addition of the step 305 also provides an audible click as the protrusion 100 slides into the step 305 of the groove 102 (or slot 102').

In a preferred embodiment, the first connector piece 37 and the second connector piece 36 are formed of a conductive material, such as one or more electrically conductive metals selected from the group consisting of silver, zinc, nickel, aluminum, copper, tin, iron, aluminum, lead, and combinations thereof.

In use, to connect the first section 70 and the second section 72 of the electronic smoking article 60, the first connector piece 37 is inserted into the second connector piece 36 and the first connector piece 37 such that the protrusions 100 of the first connector piece 37 slide along channels 301 (shown in FIGS. 5 and 10) in an internal wall 307 of the second connector piece 36. Thereupon, the first connector piece 37 is then rotated until the protrusions 100 mate with the internal grooves 102 (or slots 102'). Because the pair of protrusions 100 and the pair of internal grooves 102 (or slots 102') are positioned at about 180° apart, after insertion of the first connector piece 37 into the second connector piece 36, a quarter turn is all that is necessary to mate the protrusions 100 with the internal grooves 102 (or slots 102'). Likewise, a quarter turn also disconnects the first connector piece 37 from the second connector piece 36 so as to provide easy disassembly of the electronic smoking article 60. Moreover, since the protrusions 100 and grooves 102 (or slots 102') are in a fixed location, the connection 205 is reliably formed between the first connector piece 37 and the second connector piece 36 each time.

Figure 9:
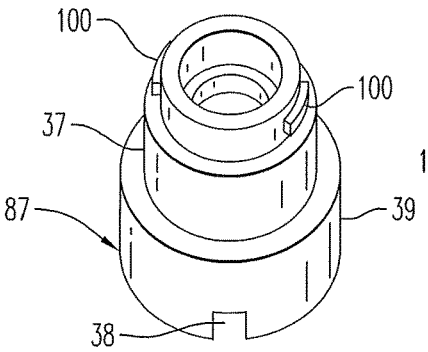
FIG. 9 is a cross-sectional view of the first connector piece of FIG. 4.

In one embodiment, shown in FIG. 9, the first connector piece 37 can include opposing notches 38 about its perimeter 39 at a downstream end, such that upon insertion of the first connector piece 37 into the casing (outer tube) 6, the notches 38 are aligned with the location of each of two RTD-controlling, air inlets 44 and 44' in the outer casing 6 so as to allow air flow into the central air channel 21 via the central air passage 20 in the gasket 15. The notches 38 can be about 1.0 to about 3.0 mm wide, preferably about 2.0 mm wide. If desired, the first connector piece 37 can include additional notches. Alternatively, the air inlets 44 can be located downstream of the first connector piece and upstream of the gasket 15.

In a preferred embodiment, as shown in FIGS. 1 and 2, the electronic smoking article 60 includes at least one air inlet 44 formed in the outer tube 6, preferably adjacent the connection 205. In the preferred embodiment, the air inlets 44, 44' are sized and configured such that the electronic smoking article 60 has a RTD in the range of from about 60 mm $H_2O$ to about 150 mm $H_2O$, more preferably about 90 mm $H_2O$ to about 110 mm $H_2O$, most preferably about 100 mm $H_2O$ to about 130 mm $H_2O$.

In a preferred embodiment, the second section 72 includes an air inlet 45 (shown in FIG. 1) at an upstream end 5 of the smoking article 60, which is sized just sufficient to assure proper operation of the puff sensor 16, located nearby. Drawing action upon a mouth end insert 8 is communicated to the puff sensor through the central air channel provided in the anode post 47*c* of the first section 70 and the anode connection post 47*b* of the second section 72 and along space 13 between the battery 1 and the casing of the second section 72, as shown in FIG. 2.

Preferably, a nose portion 93 of a downstream gasket 10 is fitted into a downstream end portion 81 of the inner tube 62. An outer perimeter 82 of the gasket 10 provides a substantially liquid-tight seal with the interior surface 97 of the outer casing 6. The downstream gasket 10 includes a central channel 84 disposed between the central passage 21 of the inner tube 62 and the interior of the mouth end insert 8 and which communicates aerosol from the central passage 21 to the mouth end insert 8.

In the preferred embodiment, the liquid supply reservoir 22 is contained in an outer annulus between inner tube 62 and outer tube 6 and between the gaskets 10 and 15. Thus, the liquid supply reservoir 22 at least partially surrounds the central air passage 21. The liquid supply reservoir 22 comprises a liquid material and optionally a liquid storage medium 210 operable to store the liquid material therein.

Preferably, the liquid storage medium 210 is a fibrous material comprising cotton, polyethylene, polyester, rayon and combinations thereof. Preferably, the fibers have a diameter ranging in size from about 6 microns to about 15 microns (e.g., about 8 microns to about 12 microns or about 9 microns to about 11 microns). Also preferably, the fibers are sized to be irrespirable and can have a cross-section which has a y shape, cross shape, clover shape or any other suitable shape. In one embodiment, the liquid storage medium may comprise a winding of cotton gauze or other fibrous material about the inner tube 62.

Also preferably, the liquid material has a boiling point suitable for use in the electronic smoking article 60. If the boiling point is too high, the heater element 14 will not be able to vaporize the liquid. However, if the boiling point is too low, the liquid may vaporize even when the heater element 14 is not activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or a nicotine-free material. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply reservoir 22 and/or liquid storage medium 210 in proximity of the 14 heater by capillary action of the wick 28. In one embodiment, the wick 28 has a first end portion 29 and a second end portion 31. The first end 29 and the second end 31 extend into opposite sides of the liquid supply reservoir 22 for contact with liquid material contained therein. Also preferably, the heater 14 at least partially surrounds a central portion of the wick 28 such that when the heater 14 is activated, the liquid in the central portion of the wick 28 is vaporized by the heater 14 to form an aerosol.

The wick 28 preferably comprises filaments having a capacity to draw a liquid, more preferably a bundle of glass (or ceramic) filaments and most preferably a bundle comprising a group of strands of glass filaments, preferably three of such strands, all which arrangements are capable of drawing liquid via capillary action via interstitial spacings between the filaments. Preferably, the wick 28 is flexible and includes three strands, each strand including a plurality of intertwined filaments. Moreover, it is noted that the end portions 29, 31 of the wick 28 are flexible and foldable into the confines of the liquid supply reservoir 22. The filaments or threads may be generally aligned in a direction perpendicular (transverse) to the longitudinal direction of the electronic smoking article. Preferably, the wick 28 includes 1 to 8 filaments, more preferably 2 to 6 filaments. In the preferred embodiment, the wick 28 includes 3 strands, each strand comprising a plurality of glass filaments twisted together. The wick 28 can include filaments having a cross-section which is generally cross-shaped, clover-shaped, Y-shaped or in any other suitable shape.

Preferably, the wick 28 includes any suitable material or combination of materials. Examples of suitable materials are glass, ceramic- or graphite-based materials. Moreover, the wick 28 may have any suitable capillarity drawing action to accommodate aerosol generating liquids having different liquid physical properties such as density, viscosity, surface tension and vapor pressure. The capillary properties of the wick 28, combined with the properties of the liquid, ensure that the wick 28 is always wet in the area of the heater 14 to avoid overheating of the heater 14.

Advantageously, the liquid material in the liquid supply reservoir 22 is protected from oxygen (because oxygen cannot generally enter the liquid supply reservoir 22 via the wick 28). In the preferred embodiment, the liquid material is also protected from light so that the risk of degradation of the liquid material is significantly reduced. Thus, a high level of shelf-life and cleanliness can be maintained.

In a preferred embodiment, the liquid supply reservoir 22 is sized and configured to hold enough liquid material such that the electronic smoking article 60 is operable for smoking for at least about 200 seconds, preferably at least about 250 seconds, more preferably at least 300 seconds and most preferably at least about 350 seconds. Thus, liquid supply reservoir 22 is equivalent to about one pack of traditional cigarettes. Moreover, the electronic smoking article 60 can be configured to allow each puff to last a maximum of about 5 seconds.

Referring to FIG. 2, the first section 70 also includes a mouth end insert 8 having at least two diverging outlets 24 (e.g., 3, 4, 5 or more, preferably 2 to 10 outlets or more, more preferably 2 to 8 outlets, even more preferably 4 to 6 outlets or 4 outlets). Preferably, the outlets 24 are located off-axis and are angled outwardly in relation to the central channel 21 of the inner tube 62 (i.e., divergently). Also preferably, the mouth end insert (or flow guide) 8 includes outlets 24 uniformly distributed about the perimeter of mouth end insert 8 so as to substantially uniformly distribute aerosol in a smoker's mouth during use and create a greater perception of fullness in the mouth. Thus, as the aerosol passes into a smoker's mouth, the aerosol enters the mouth and moves in different directions so as to provide a full mouth feel. In contrast, electronic smoking article a having a single, on-axis orifice tend to direct its aerosol as single jet of greater velocity toward a more limited location within a smoker's mouth.

In addition, the diverging outlets 24 are arranged and include interior surfaces such that droplets of unaerosolized liquid material, if any, that may be entrained in the aerosol impact the interior surfaces 83 of the mouth end insert 8 and/or impact portions of walls which define the diverging outlet passages 24. As a result such droplets are substantially removed or broken apart, to the enhancement of the aerosol.

In the preferred embodiment, the diverging outlet passages 24 are angled at about 5° to about 60° with respect to the longitudinal axis of the outer tube 6 so as to more completely distribute aerosol throughout a mouth of a smoker during use and to remove droplets. In a preferred embodiment, there are four diverging outlet passages 24 each at an angle of about 40° to about 50° with respect to the longitudinal axis of the outer tube 6, more preferably about 40° to about 45° and most preferably about 42°.

Preferably, each of the diverging outlet passages 24 has a diameter ranging from about 0.015 inch to about 0.090 inch (e.g., about 0.020 inch to about 0.040 inch or about 0.028 inch to about 0.038 inch).

The mouth end insert 8 may be integrally affixed within the tube 6 of the cartridge 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In the preferred embodiment, the power supply 1 includes a battery arranged in the electronic smoking article 60 such that the anode 47*a* is downstream of the cathode 49*a*. A battery anode connection post 47*b* of the second section 72 preferably contacts the battery anode 47*a*. The outer casing 6 is preferably formed of metal so as to complete the electrical circuit.

More specifically, electrical connection between the anode 47*a* of the battery 1 and the heater coil 14 in the first section 70 is established through a battery anode connection post 47*b* in the second section 72 of the electronic smoking article 60, an anode post 47*c* of the cartridge 70 and an electrical lead 47*d* connecting a rim portion of the anode post 47*c* with one end of the heater element 14. Likewise, electrical connection between the cathode 49*a* of the battery 1 and the other end of the heater coil 14 is established through the connection 205 between the second connection piece 36 of the second portion 72 and the first connector piece 37 of the first section 70 and from there through an electrical lead 49*c* which electrically connects the connection 205 to the opposite lead 47*d* of the heater coil 14. The outer casing 6 can be formed of a metal so as to complete the electrical connection.

Preferably, the electrical leads 47*d*, 49*c* are highly conductive and temperature resistant while a coiled section of the heater 14 is highly resistive so that heat generation occurs primarily along the coils of the heater 14. Also preferably, the electrical lead 47*d* is preferably connected to the heater lead by crimping. Likewise, the electrical lead 49*c* is connected to the heater lead by crimping. In an alternative embodiment, the electrical leads 47*d*, 49*c* can be attached to the heater leads via soldering. Crimping is preferred as it speeds manufacture.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted or in the case of lithium polymer battery, a minimum voltage cut-off level is achieved.

Preferably, the power supply 1 may be rechargeable and include circuitry allowing the battery to be chargeable by an external charging device. In that case, preferably the power supply, when charged, provides power for a pre-determined number of puffs, after which the recharging circuitry of the power supply must be re-connected to an external charging device. To recharge the electronic smoking article 60, an USB charger or other suitable charger assembly can be used.

Preferably, the electronic smoking article 60 also includes control circuitry including a puff sensor 16. The at least one air inlet 45, shown in FIG. 1, is located adjacent the puff sensor 16, such that the puff sensor 16 may sense air flow indicative of a smoker taking a puff and activates the power supply 1 and the heater activation light 48 to indicate that the heater 14 is working.

As shown in FIG. 2, the control circuitry can also include a heater activation light 48 operable to glow when the heater 14 is activated. Preferably, the heater activation light 48 comprises at least one LED and is at an upstream end of the electronic smoking article 60 so that the heater activation light 48 takes on the appearance of a burning coal during a puff. Moreover, the heater activation light 48 can be arranged to be visible to the smoker. In addition, the heater activation light 48 can be utilized for cigarette system diagnostics or to indicate that recharging is in progress. The light 48 can also be configured such that the smoker can activate and/or deactivate the light 48 for privacy, such that the light 48 would not activate during smoking if desired.

Alternatively, the control circuitry may include a manually operable switch for a smoker to initiate a puff. The time-period of the electric current supply to the heater may be pre-set depending on the amount of liquid desired to be vaporized. Alternatively, the circuitry may supply power to the heater 14 for a pre-set time period when the puff sensor 16 detects a pressure drop.

Preferably, when activated, the heater 14 heats a portion of the wick 28 surrounded by the heater for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

Preferably, the heater 14 is a wire coil that surrounds the wick 28. Examples of suitable electrically resistive materials include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater can be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. Preferably, the heater 14 comprises at least one material selected from the group consisting of stainless steel, copper, copper alloys, nickel-chromium alloys, super alloys and combinations thereof. In a preferred embodiment, the heater 14 is formed of nickel-chromium alloys or iron-chromium alloys, although the latter is not preferred for reasons which follow. In another embodiment, the heater 14 can be a ceramic heater having an electrically resistive layer on an outside surface thereof.

In another embodiment, the heater 14 may be constructed of an iron-aluminide (e.g., FeAl or $Fe_3Al$), such as those described in U.S. Pat. No. 5,595,706 to Sikka et al., or nickel aluminide (e.g., $Ni_3Al$). Use of iron-aluminide is advantageous in that iron-aluminide exhibits high resistivity. FeAl exhibits a resistivity of approximately 180 micro-ohms, whereas stainless steel exhibits approximately 50 to 91 micro-ohms. The higher resistivity lowers current draw or load on the power source (battery) 1.

In a preferred embodiment, the heater coil 14 is formed from a nickel-chromium alloy that is essentially free of iron content. Experience has indicated that heater coils constructed from an iron chromium alloy suffered oxidation of their iron content if the alloys were contacted with water during manufacturing operations, during shelf-life and/or operation of the device.

In a preferred embodiment, the inner tube 62 is constructed from woven fiberglass. Moreover, in a preferred embodiment, the inner tube 62 has a diameter of about 4 mm and opposing slots 63 therein having major and minor dimensions of about 2 mm by about 4 mm. Preferably, the end portions 29, 31 of the wick 28 extend through the opposing slots (not shown) in the inner tube 62.

In one embodiment, the heater 14 comprises a wire coil which at least partially surrounds the wick 28. In that embodiment, preferably the wire is a metal wire and/or the heater coil may extend fully or partially along the length of the wick 28. The heater coil 14 may extend fully or partially around the circumference of the wick 28. In another embodiment, the heater coil is not in contact with the wick 28.

Preferably, the heater 14 heats liquid in the wick 28 by thermal conduction. Alternatively, heat from the heater 14 may be conducted to the liquid by means of a heat conductive element or the heater 14 may transfer heat to the incoming ambient air that is drawn through the electronic smoking article 60 during use, which in turn heats the liquid by convection.

The teachings herein are applicable to all forms of electronic smoking articles, such as electronic cigarettes, cigars, pipes, hookahs and others regardless of their size and shape.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic smoking article comprising:

a resilient gasket;

a first section including an outer housing, and a liquid supply reservoir;

a second section including an outer housing and a power supply, the first section configured to be connected to the second section at a connection, the connection including, a first connector piece extending in a longitudinal direction and including, a body portion having a first end and a second end, and protrusion extending outwardly from an outer periphery of the body portion; and a second connector piece extending in the longitudinal direction, the second connector piece including a longitudinally extending channel along an internal wall of the second connector piece, the longitudinally extending channel configured to slidingly receive said protrusion of the first connector piece when the first connector piece is inserted into the second connector piece, and the resilient gasket arranged to be compressed when the first connector piece is inserted into the second connector piece.

2. The electronic smoking article of claim 1, wherein the protrusion of the first connector piece includes at least two protrusions which comprise two arcuate protrusions arranged about 180 degrees apart.

3. The electronic smoking article of claim 1, wherein the longitudinally extending channel of the second connector piece includes at least two longitudinally extending channels along the internal wall of the second connector piece arranged about 180 degrees apart.

4. The electronic smoking article of claim 1, wherein the second connector piece further includes a circumferential groove along the internal wall of the second connector piece, said circumferential groove in communication with said longitudinally extending channel; and the protrusion is further configured to mate with the circumferential groove.

5. The electronic smoking article of claim 4, wherein the second connector piece further includes an external spring clip configured to provide audible feedback when the protrusion is mated with the circumferential groove.

6. The electronic smoking article of claim 4, wherein the second connector piece further includes an external spring clip having an appendage configured to slide into said circumferential groove.

7. The electronic smoking article of claim 6, wherein the external spring clip comprises a leaf spring or a wire spring.

8. The electronic smoking article of claim 4, wherein said resilient gasket is arranged to be compressed axially when said first connector piece is inserted into said second connector piece.

9. The electronic smoking article of claim 1, wherein the protrusion of the first connector piece comprises four protrusions arranged about 90 degrees apart.

10. The electronic smoking article of claim 1, wherein the longitudinally extending channel comprises four longitudinally extending channels along the internal wall of the second connector piece arranged about 90 degrees apart.

11. The electronic smoking article of claim 1, wherein the first connector piece further includes at least one notch at one or more of the ends of the body portion.

12. The electronic smoking article of claim 11, wherein the first connector piece further includes a central air passage extending longitudinally through a central portion of the body portion in communication with the at least one notch.

13. The electronic smoking article of claim 1, wherein the first section further comprises:

an inner tube within the outer housing;

the liquid supply reservoir comprising a liquid material, the liquid supply reservoir contained in an outer annulus between the outer housing and the inner tube;

a coil heater located in the inner tube; and a wick in communication with the liquid supply reservoir and surrounded by the coil heater such that the wick delivers liquid material to the coil heater and the coil heater heats the liquid material to a temperature sufficient to vaporize the liquid material and form an aerosol in the inner tube.

* * * * *